United States Patent [19]

Moore

[11] 4,074,122

[45] Feb. 14, 1978

[54] FLUORESCENT LANTERN

[75] Inventor: Arthur H. Moore, Fairfield, Conn.

[73] Assignee: The Bridgeport Metal Goods Manufacturing Company, Bridgeport, Conn.

[21] Appl. No.: 654,156

[22] Filed: Feb. 2, 1976

[51] Int. Cl.[2] ..... F21L 7/00

[52] U.S. Cl. ..... 362/200; 362/223

[58] Field of Search ..... 240/10.5, 10.6 R, 10.63, 240/11.2 R, 11.4 R, 11.4 N

[56] References Cited

U.S. PATENT DOCUMENTS

| | | | |
|---|---|---|---|
| 2,435,164 | 1/1948 | Sobel | 240/11.4 R |
| 3,794,825 | 2/1974 | Krupansky | 240/10.6 R |
| 3,947,678 | 3/1976 | Tang | 240/11.4 R |

*Primary Examiner*—L. T. Hix
*Assistant Examiner*—William B. Perkey
*Attorney, Agent, or Firm*—Wooster, Davis & Cifelli

[57] ABSTRACT

A fluorescent lantern generally comprising a single piece chassis and a cover which removably fits over the rear portion of the chassis. The chassis has a unitary reflector section with a pair of integral sockets for supporting the electrical contacts of a fluorescent lamp. A compartment section for housing the battery and switching mechanism is integrally disposed on the back of the reflector section. When properly mounted in the compartment section, the batteries are electrically connected to the fluorescent lamp through the switching mechanism and the reflector sockets. The switching mechanism is also used to selectively make and break the electrical circuit from the battery to the lamp.

7 Claims, 8 Drawing Figures

FLUORESCENT LANTERN

BACKGROUND OF THE INVENTION

This invention relates to an improvement in portable fluorescent lanterns. These lanterns, which are becoming increasingly well-known, are very useful as they provide a self-contained, portable light source which, unlike standard lanterns or flashlights, is capable of illuminating a large area.

There are several types of prior art fluorescent lanterns. Most are generally comprised of a chassis having a reflector assembly and housing the batteries and switching mechanism and a lantern cover which fits over and attaches to the rear of the chassis. In some prior art fluorescent lanterns, the battery and switching mechanism compartments, as well as the reflector assembly are all individual parts which must be fabricated separately. In addition, many subassembly parts, such as the lamp sockets of the reflector, are also made individually. As a result, the prior art fluorescent lanterns are expensive to manufacture because of the separate fabrication of their many parts and the time-consuming assembly the parts require.

Besides being expensive to manufacture, the prior fluorescent lanterns have another major drawback. The electrical connections within the prior art lanterns are generally complex. A number of conductive and specially insulated parts are needed to make the electrical connections within the lamp sockets. In addition, the battery and switch mechanism connections often involve an additional number of electrical parts as well as extensive wiring. Because of the number and nature of the electrical connections in the prior art lanterns, expensive machine operations, such as riveting, and expensive manual operations, such as soldering, wire crimping and sleeving, are necessary which further increase the cost of manufacture. More importantly, however, the large number of parts and connections increase the possibility of lantern failure. Nevertheless, despite their high cost and lack of reliability, these fluorescent lanterns are becoming widely used.

SUMMARY OF THE INVENTION

The fluorescent lantern according to the invention herein is less expensive to manufacture and more dependable than prior art fluorescent lanterns. The improved lantern comprises only two basic parts which are a single piece chassis and a chassis cover which removably fits over the rear portion of the chassis when the lantern is assembled.

The lantern chassis of this invention is of nonconductive material and has a unitary reflector section and an integral compartment section. The reflector section has a concave reflector which removably supports a tube-shaped fluorescent lamp having an electrical terminal at each end. When the lamp is in place, each of these lamp terminals rests inside one of a pair of sockets.

A nonconductive compartment section is integrally disposed on the back of the reflector section opposite the fluorescent lamp. The compartment section has a pair of battery sections separated by a centrally disposed switching mechanism compartment.

A standard switching mechanism is placed in the central compartment, and the batteries when properly mounted in the battery sections, are automatically electrically connected to the switching mechanism. The switching mechanism connects the batteries in series and electrically connects each of the terminals of the series-connected batteries to one of the terminals of the fluorescent lamp inside the sockets of the reflector assembly. The switching mechanism also provides the means for selectively making and breaking the electrical circuit from the batteries to the lamp. when the switching mechanism is turned on, the electrical circuit is completed to each of the lamp terminals thereby firing the fluorescent lamp causing it to glow.

Since the entire chassis is made in one piece, the more expensive manufacture of many separate parts, as well as the expense of assembling the parts is avoided. Further, the electrical parts which are numerous in prior art lanterns are kept to a minimum.

Accordingly, a principal object of the invention is to provide a fluorescent lantern which is more economical to manufacture than known fluorescent lanterns.

Another object of the invention is to provide a fluorescent lantern which has a simple construction and is more reliable than known fluorescent lanterns.

Other and more specific objects of the invention will be in part obvious and will in part appear from the following description of the preferred embodiment and claims taken together with the drawings.

DRAWINGS

The same reference numbers refer to the same elements throughout the various figures.

DESCRIPTION OF THE PREFERRED EMBODIMENTS

Figure 1:
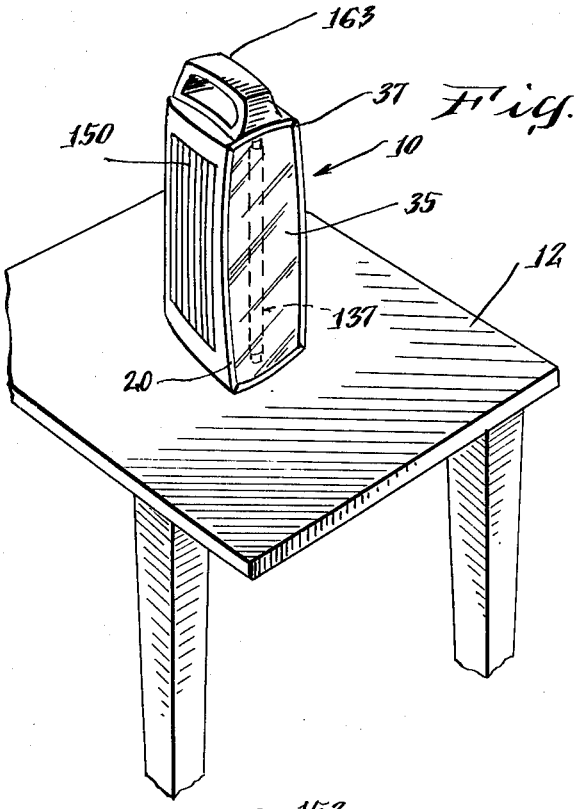
FIG. 1 is a perspective view of the fluorescent lantern according to the invention herein in its upright position.

Referring now to the FIG. 1, a fluorescent lantern according to the lantern herein is shown at 10 in an upright position upon a table 12. The fluorescent lantern 10 generally comprises two main elements which are a single piece chassis 20 and a lantern cover 150.

Figure 5:
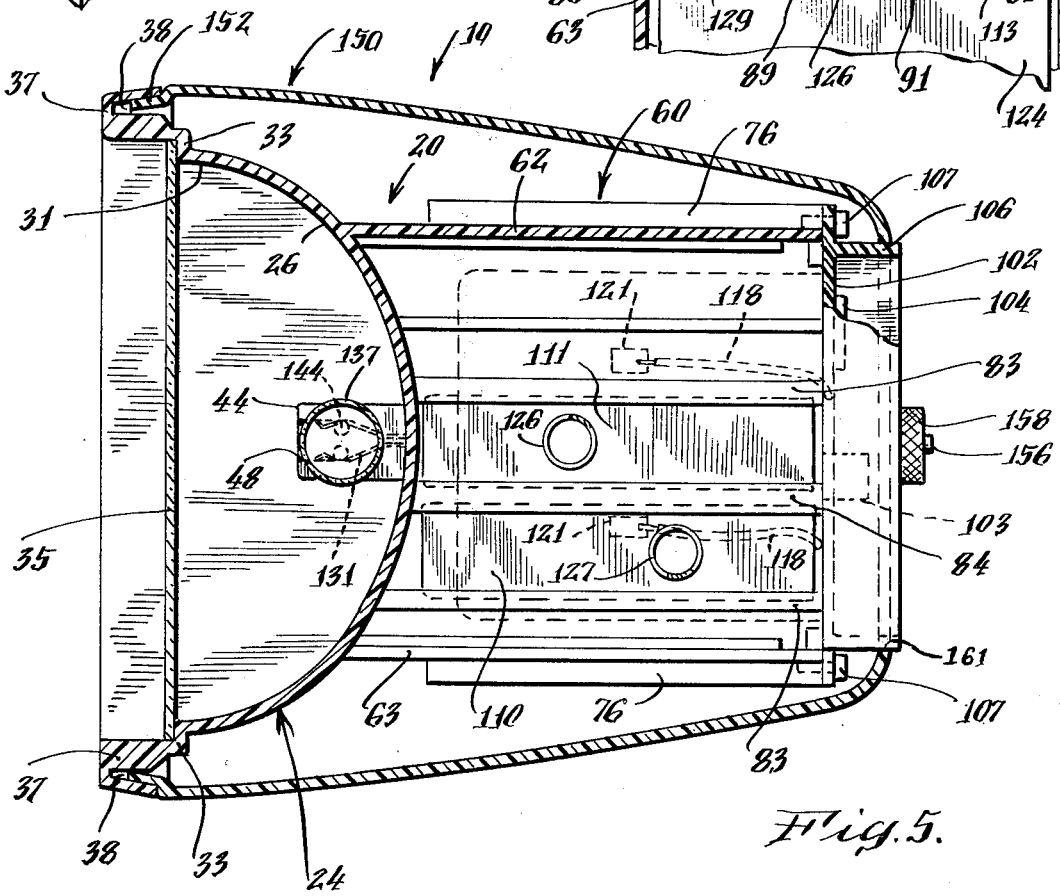
FIG. 5 is an enlarged cross-sectional view taken along lines 5—5 of FIG. 4.
Figure 2:
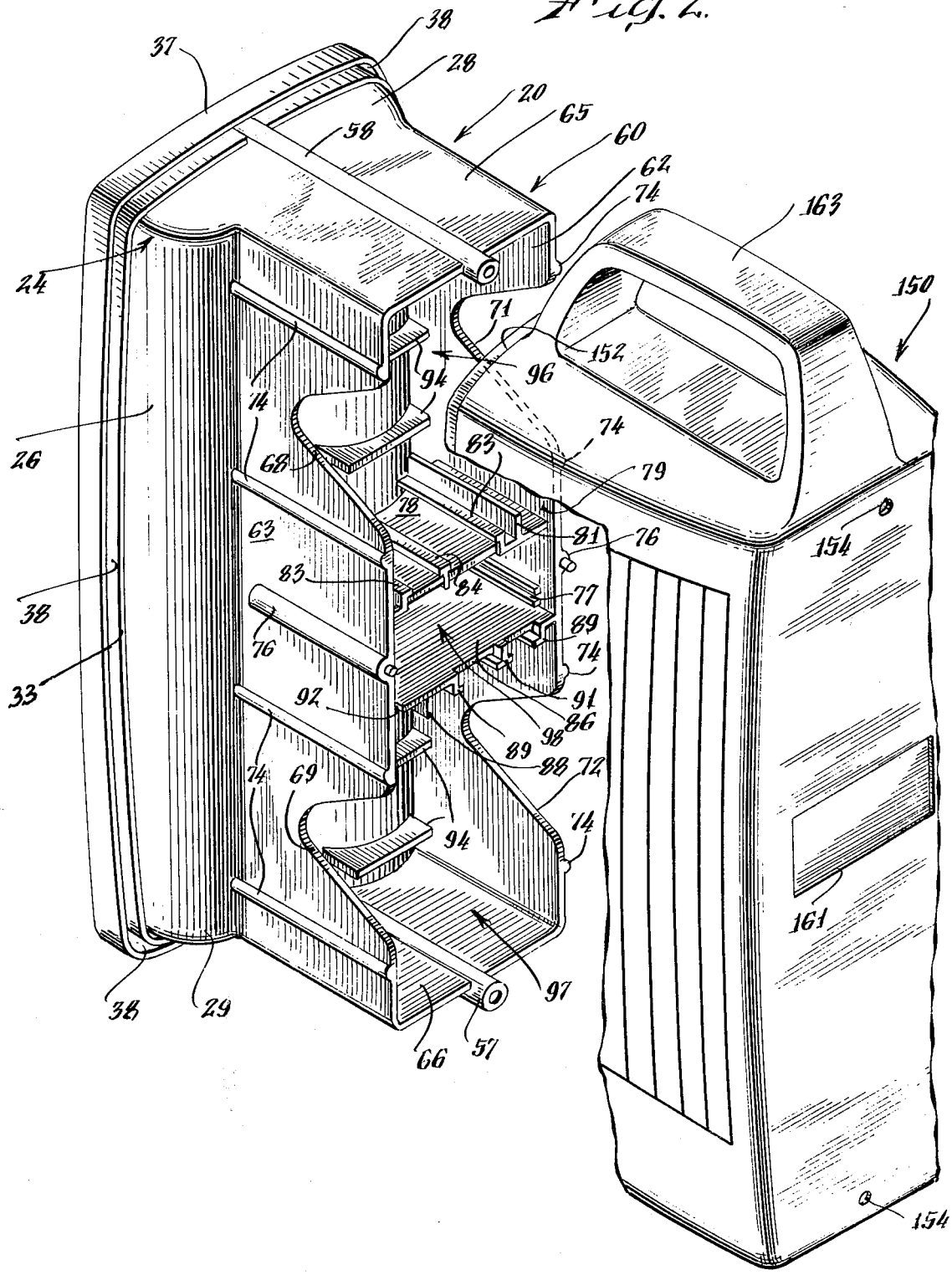
FIG. 2 is an enlarged perspective rear view of the lantern chassis and its cover with a portion of the cover cut away.
Figure 8:
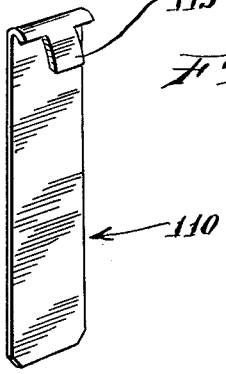
FIG. 8 is an enlarged perspective view of the metal contact strip of the invention.
Figure 3:
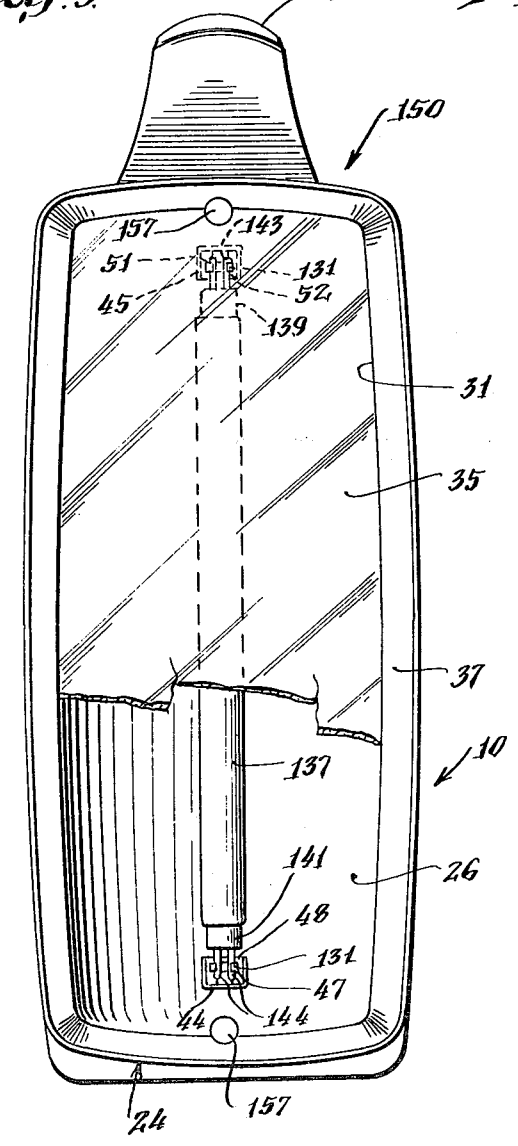
FIG. 3 is an enlarged frontal view of the fluorescent lantern with a portion of the lens cut away.

The lantern chassis 20 is made of nonconductive material, such as molded plastic, and as shown in FIG. 2 is generally comprised of a reflector section 24 and an integral compartment rectangular section 60. The reflector section 24 is comprised of a concave rectangular reflector 26 which is longitudinally aligned with and extends the length of the chassis 20. As shown in FIG. 5, the reflector 26 has a substantially semicircular cross section. A semicircular top wall 28 is integrally disposed on the upper end of the reflector 26, as best shown in FIG. 2, and a bottom wall 29 is integrally similarly disposed on the lower end of the reflector 26 thereby defining with the reflector 26 a substantially rectangular lens opening 31, as shown in FIG. 3.

As shown in FIG. 5, the concave rectangular reflector 25 has a peripheral lip 33 disposed at its lens opening 31 and extending outwardly therefrom. A substantially rectangular transparent lens 35 is supported by the lip 33 when the lantern 10 is assembled. The lens 35 covers the entire lens opening 31 of the reflector section 24.

A sealing rim 37 peripherally surrounds the outside of the entire lens opening 31. The sealing rim 37 is integral with the lip 33 of the reflector 26 and with the front edges of both the top wall 28 and bottom wall 29. The sealing rim 37 has a rear slot 38 which tapers to a close near the front of the sealing rim 37. The slot 38 extends around the entire sealing rim 37, as best shown in FIG. 2.

Figure 7:
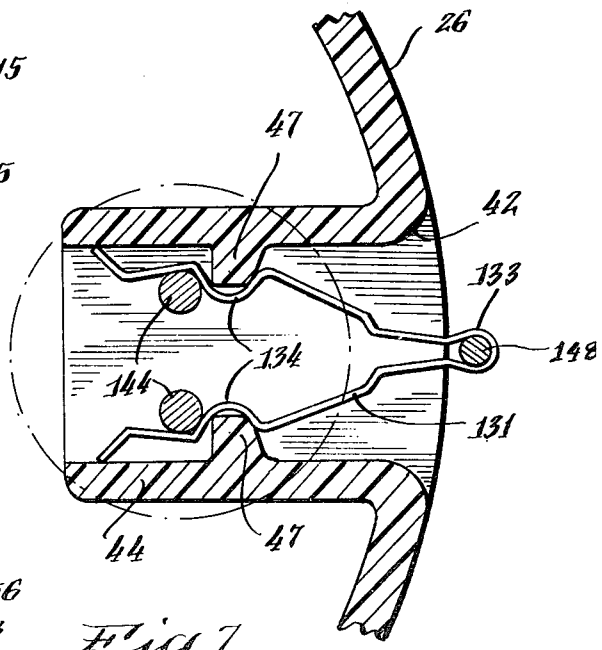
FIG. 7 is an enlarged cross-sectional view of the socket of the invention taken along lines 7—7 of FIG. 4.

A rectangular bottom socket hole 42 extends through the reflector 26 at its apex near the bottom wall 29. A similar top socket hole 41 located near the top wall 28 of the reflector 26 is longitudinally aligned with the bottom socket hole 42. A substantially rectangular bottom socket 44 having an open top and bottom surrounds and is aligned with the bottom socket hole 42. The bottom socket 44 which is integral with the reflector 26 has a pair of integral ridges 47 internally disposed on the sides of the bottom socket 44 at its approximate midpoint, as shown in FIG. 7. The ridges 47 extend the length of the sides of the bottom socket 44. The upper portion of the side of the bottom socket 44 facing the top wall 28 is cut away forming a lamp opening 48. The lamp opening 48 extends from the top of the bottom socket 44 to the ridges 47.

A top socket 45 which is configured identically as the bottom socket 44 is disposed around the top socket hole 41. The top socket 45 has a pair of top socket ridges 51 and a lamp opening 52 which faces the lamp opening 48 of the bottom socket 44, as shown in FIG. 3.

Figure 4:
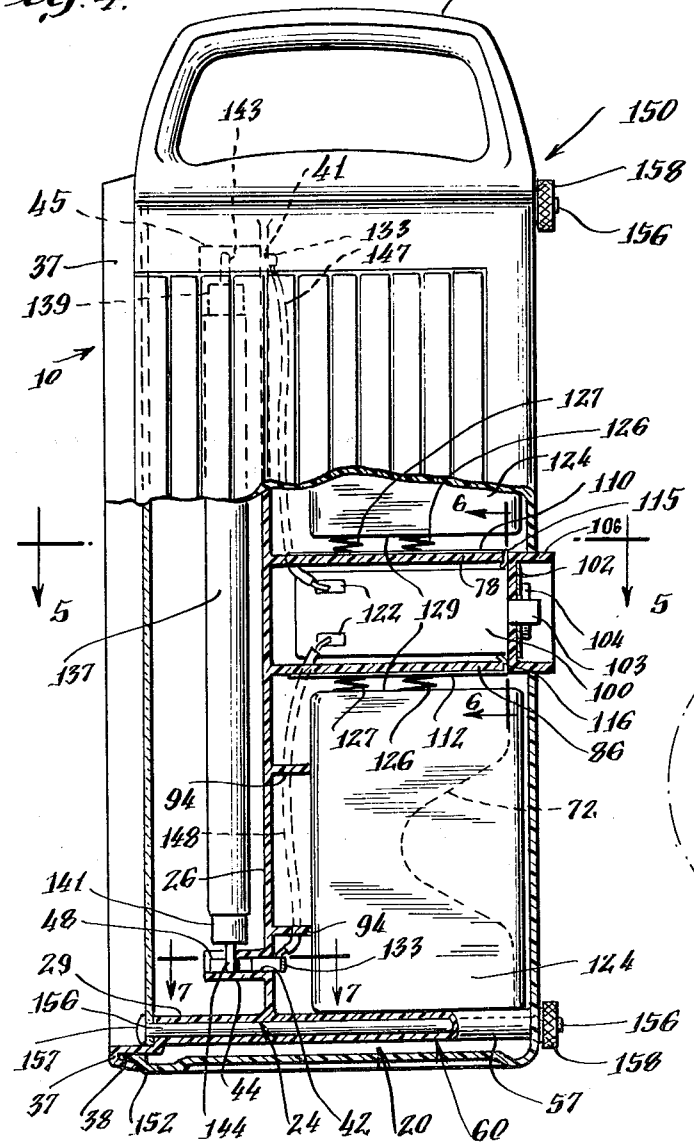
FIG. 4 is an enlarged side elevational view of the fluorescent lantern with a portion of the cover and a portion of the chassis cut away.

The rectangular compartment section 60 is centrally disposed on the rear of the reflector 26 opposite the lens opening 31. As shown in FIG. 2, the rectangular compartment section 60 is longitudinally aligned with and integral with the reflector section 24. The compartment section 60 has a right sidewall 62 and a left sidewall 63 which are connected at their ends by an integral top portion 65 and an integral bottom portion 66. A first bolt cylinder 57 is centrally disposed on the outside of the bottom portion 66 and extends from slightly above the rear edge of the bottom portion 66 along the bottom wall 29 of the reflector section 24 to the reflector lip 33, as shown in FIG. 4. A similar second bolt cylindr 58 is centrally disposed on the outside of the top portion 65 and extends from slightly above the rear edge of the top portion 65 along the top wall 28 to the lip 33 of the reflector section 24, as shown in FIG. 2. The left sidewall 63 has a first "V" shaped slot 68 in its upper end near the top portion 65, and a second lower "V" shaped slot 69 located opposite the first "V" shaped slot near the bottom portion 66. A third "V" shaped slot 71 and a fourth "V" shaped slot 72 are similarly disposed in the right sidewall 62 so that upper slots 68, 71 are laterally aligned with each other and the lower slots 69, 72 are also laterally aligned.

Both sidewalls 62, 63 have a plurality of integral structural ribs 74 which extend horizontally from the reflector section 24 to the rear of the chassis 20, as shown in FIG. 2. The ribs 74 act to strengthen the sidewalls 62, 63. A hollow, cylindrical screw receptacle 76 is centrally disposed on each of the sidewalls 62, 63 perpendicular to the longitudinal axes of the sidewalls 62, 63. The screw receptacles 76 which are integral with the sidewalls 62, 63, extend from the rear edge of the sidewalls 62, 63 almost to the reflector section 24. The screw receptacles 76 are internally screw threaded. A pair of switching mechanism standoffs 77 is disposed on the inside of each sidewall 62, 63 just below the receptacles 76, as shown in FIG. 6.

Figure 6:
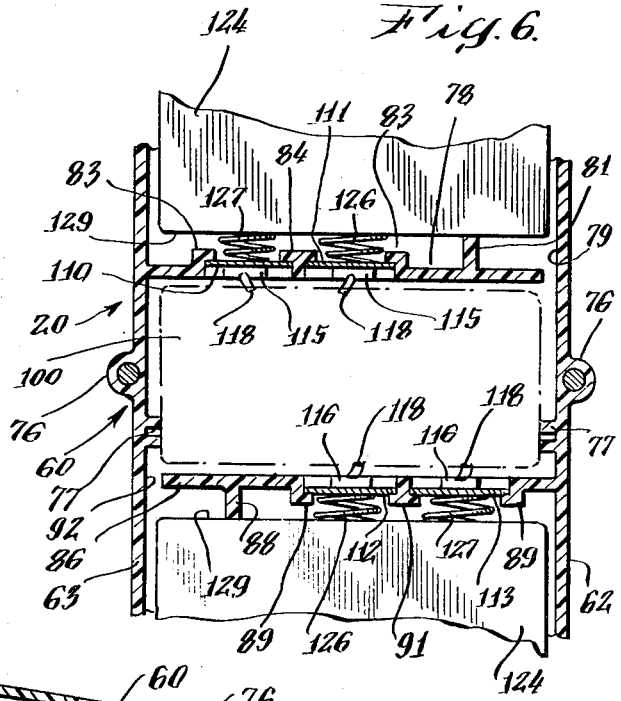
FIG. 6 is an enlarged cross-sectional view taken along lines 6—6 of FIG. 4.

As shown in FIGS. 2 and 6, the left sidewall 63 has an integral upper divider wall 78 which extends perpendicularly from a point just above the midpoint of the left sidewall 63 almost to the right sidewall 62. The upper divider wall is parallel to the top portion 65 and combines with the top portion 65 and the upper section of both sidewalls to define an upper compartment 96, as shown in FIG. 2. The upper divider wall 78 also defines an upper wiring opening 79 with the right sidewall 62.

The upper divider wall 78 has an integral battery standoff 81 which is disposed near the right sidewall 62 so as to project into the upper battery compartment 96. The upper divider wall 78 also has a pair of integral "L" shaped ridges 83 disposed in the upper battery compartment side of the wall 78 so that the ridges 83 point towards each other, as shown in FIG. 6. A "T" shaped separator 84 which is integral with the divider wall 78 is centrally disposed between the "L" shaped ridges 83.

The right sidewall 62 has an integral lower divider wall 86 disposed parallel to the upper divider wall 78 and equidistant from the midpoint of the lantern 10. The lower divider wall 86 defines a lower battery compartment 97 with the bottom portion 66 and the lower sections of the right sidewall 62 and left sidewall 63. The lower divider wall also defines a central switching mechanism compartment 98 with the upper divider wall 78.

The lower divider wall 86 is configured identically as the upper divider wall 78. The lower divider wall 86 has a battery standoff 88 projecting into the lower battery compartment 97, as shown in FIG. 6, and a pair of "L" shaped ridges 89 separated by an integral "T" shaped separator 91 as with the upper divider wall 78. The lower divider wall 86 also defines a lower wiring opening 92 with the left sidewall 63, as shown in FIG. 6.

A series of battery supports 94 are disposed in the bottom of the battery compartments 96, 97, as shown in FIG. 2. The battery supports which are integral with the back of the reflector 26 are spaced apart and arranged parallel to the divider walls 78, 86. The battery supports 94 are all of the same height and have level top edges which form a plane perpendicular to the sidewalls 62, 63. Up until this point, the entire chassis 20 with the exception of the lens 35 is a single unitary structure.

A switching mechanism 100 which is a standard electrical device for connecting batteries in series is removably inserted into the switching mechanism compartment 98 and the switching mechanism standoffs 77 of the sidewalls 62, 63 centrally position the switching mechanism 100, as shown in FIG. 6. The switching mechanism 100 has a top plate 102 having an on-off switch 103 and an accessory plug 104. A protective wall 106 extending away from the top plate 102 surrounds the switch 103 and plug 104. The switching mechanism 100 is held in place by a pair of screws 107 which fit through the loop plate 102 and into each of the screw receptacles 76 on the respective sidewalls 62, 63, as shown in FIG. 5.

A pair of metal contact strips 110, 111, having a curved end piece 115 are placed between the "L"

shaped ridges 83 of the upper divider wall 78 in such a manner that end pieces 115 fit over the top of the divider wall 78 into the switching mechanism compartment 98, and the strips 110, 111 themselves extend from the top of the wall 78 to near the reflector 26. The two metal strips 110, 111 are insulated from each other by the "T" separator 84. A similar pair of metal contact strips 112, 113 having a curved end piece 116 are disposed between the "L" shaped ridges of the lower divider wall 86 and insulated from each other by the "T" separator 91 of that wall 86. Wires 118 electrically connect the end pieces 115, 116 of all the metal strips 110–113 to input contact points 121 on both sides of the switching mechanism 100.

A pair of standard D-type square batteries 124 each having a centrally disposed coil spring terminal 126 and a peripherally disposed coil spring terminal 127 on their top surfaces 129 are inserted into the battery compartments 96, 97 so that the top surface 129 of each battery 124 faces the respective divider wall 78, 86, as shown in FIG. 4. When the batteries 124 are inserted properly, the central terminal 126 will contact one of the metal contact strips 111, 112 while the other peripheral terminal 127 will contact the other metal strips 110, 113, as shown in FIG. 6. The batteries 124 are thereby electrically connected to the switching mechanism 100. The switching mechanism 100 connects the batteries 124 in series and provides a pair of output terminals 122 of opposite polarity, as shown in FIG. 4. As shown in FIG. 6, the battery standoffs 81, 88 force the top surfaces 129 of the batteries 124 away from the divider walls 78, 86 thereby preventing the spring terminals from becoming over compressed.

A pair of resilient contact clips 131 which are electrically conductive are snap fit inside the top socket 45 and bottom socket 44 through the respective socket holes 41, 42 of the reflector section 24. As shown in FIG. 7, the clip 131 has a base 133 which protrudes through the socket hole 42 into the compartment section 60 when the clip 131 is in place. The clip 131 also has a pair of indentations 134 which fit over the socket ridges 47 and cooperate with the ridges 47 to hold the clip 131 in place. The other clip 131 is similarly configured and similarly disposed in the top socket 45.

As shown in FIGS. 3 and 4, a cylindrical fluorescent lamp 137 having a first terminal 139 at one end and a second terminal 141 at the opposite end is removably disposed between the top socket 45 and the bottom socket 44. As best shown in FIG. 3, both terminals 139, 141 have a pair of contact bars 143, 144. When the fluorescent lamp 137 is in place in the lantern 10, the contact bars 143, 144 rest inside the bottom socket 44 and the top socket 45 on the respective socket ridges 47, 51, as shown in FIGS. 3 and 7. The contact bars 143, 144 thereupon make electrical contact with the resilient contact clips 131 inside the sockets 44, 45 and also create a force fit between the contact bars 143, 144 and the clips 131 thereby holding the fluorescent lamp in place in the sockets 44, 45. A wire 147 electrically connects the base 133 of the clip 131 in the top socket 45 to one of the output terminals 122 of the switching mechanism 100, while another wire 148 electrically connects the base 133 of the clip 131 in the bottom socket 44 to the output terminal 122 of opposite polarity. The wires 147, 148 are passed through the respective wiring openings 79, 92 between the divider walls 78, 86 and the sidewalls 62, 63. When the switching mechanism 100 is selectively turned on by the switch button 103, the electrical circuit is completed from the batteries 124 to the lamp 137 causing the lamp 137 to fire. The lamp 137 remains illuminated as long as the circuit is unbroken.

A cover 150 having a handle 163 and a front edge 152 fits over the rear of the chassis 20 when the lantern 10 is assembled. The front edge 152 fits into the slot 38 of the sealing rim 37 of the reflector section 24. As shown in FIG. 2, the cover 150 has a pair of bolt holes 154 in its back opposite its front edge 152 which align with the bolt cylinders 57, 58 of the chassis 20 when the cover 150 is in place. The cover 150 also has a rectangular switch opening 161 centrally disposed between the bolt holes 154. The switch opening 161 is slightly larger than the protective wall 106 on the top plate 102 of the switching mechanism 100. When the cover 150 is in place, the protective wall 106 aligns with the switch opening 161 and the protective wall 106 partially extends outside the cover 150 as shown in FIGS. 4 and 5 thereby providing operator access to the switch button 103 and accessory plug 104.

The cover 150 is held in place by a pair of bolts 156 which fit into the bolt cylinders 57, 58 of the chassis 20. The bolts 156 have an enlarged head 157 which is too large to pass through the bolt cylinders 57, 58. The bolts 156 are inserted into the front of the chassis 20 where the enlarged heads 157 also serve to retain the lens 35 in place, as shown in FIG. 4. The ends of the bolts 156 opposite the heads 157 are screw threaded and protrude through the rear of the bolt cylinders 57, 58 and through the corresponding bolt holes 154 of the cover 150. A screw threaded nut 158 is attached to each of the protruding end portions of the bolts 156, and the cover 150 is secured in place.

Manufacture of this improved lantern is quicker and less costly than other known lanterns. Construction consists entirely of fabricating the single piece chassis and inserting the standard switching mechanism with the already attached wires. The few electrical parts which are required are merely fitted in place without such time-consuming and expensive hand operations, such as riveting, soldering, crimping or sleeving. Therefore, manufacture is simplified, and the cost is substantially reduced. From the foregoing description of the invention and discussion of the prior lanterns, the numerous advantages and improvements incident to the invention will all be apparent to those skilled in the art.

Accordingly, the above description of the invention is to be construed as illustrative only rather than limiting. This invention is limited only by the scope of the following claims.

I claim:

1. A fluorescent lantern comprising a single piece chassis, said chassis having a unitary reflector section and a compartment section integral with said reflector section, battery means disposed in said compartment section, a fluorescent lamp supported by said reflector section so as to direct its light outwardly from said chassis, and means for electrically connecting said fluorescent lamp to said battery means, wherein said unitary reflector section is comprised of a concave rectangular reflector, said concave reflector defining a lens opening, a sealing rim integral with said concave reflector being peripherally disposed around said lens opening, said concave reflector also having a pair of integral sockets located at opposite ends of said concave reflector, said sockets being aligned on the apex of said concave reflector facing said lens opening, and wherein said compartment section is rectangular and longitudinally aligned with said reflector section, said compartment section being integral with said concave reflector opposite said sockets and said lens opening, and wherein said compartment section is comprised of a pair of sidewalls connected together at each end by a pair of integral end portions, each of said sidewalls also having an integral perpendicular divider wall extending almost to the opposite sidewall, each of said divider walls being disposed equidistant to but on opposite sides of the midpoint of said compartment section, said divider walls thereby defining with a portion of said sidewalls a switching mechanism compartment between themselves, and each divider wall also defining a battery compartment with a portion of said sidewalls and said end portion closest to said divider wall.

2. A fluorescent lantern as defined in claim 1 wherein said battery means comprises a pair of batteries, said batteries having a peripherally disposed terminal and a centrally disposed terminal both of which are located on the front surface of said battery, each of said batteries being removably disposed in one of said battery compartments so that each of said battery terminals contacts a metal contact strip mounted on said divider walls, said metal strips being separated from each other by a series of separators and ridges integral with said divider walls.

3. A fluorescent lantern as defined in claim 2 wherein a standard switching mechanism is disposed in said switching mechanism compartment, said switching mechanism being electrically connected to said metal contact strips and combining said batteries in series when said batteries are in place in said battery compartments, said switching mechanism also having a pair of output terminals of opposite polarity which are internally connected to said series combined batteries.

4. A fluorescent lantern as defined in claim 3 wherein said fluorescent lamp is comprised of a gas filled cylindrical tube having an electrical contact at each end, said lamp being fired thereby becoming illuminated when each of said contacts is connected to one of said output terminals of said switching mechanism when said batteries are in place.

5. A fluorescent lantern as defined in claim 4 wherein said contacts of said fluorescent lamp rest in and are supported by said sockets, each of said sockets having a resilient conductive clip mounted therein, each of said clips being electrically connected to one of said output terminals of said switching mechanism and contacting said contacts of said lamp when said lamp is in place.

6. A fluorescent lantern as defined in claim 5 wherein said switching mechanism provides a means to selectively break the electrical circuit from said batteries to said clips in said sockets.

7. A fluorescent lantern as defined in claim 6 wherein said chassis has a removable cover, said cover being configured to fit over the rear portion of said chassis so that a front edge of said cover fits into said sealing rim of said chassis.

* * * * *